US008585142B2

(12) United States Patent
Jamele et al.

(10) Patent No.: US 8,585,142 B2
(45) Date of Patent: Nov. 19, 2013

(54) MOTION SEAT SYSTEMS AND METHODS OF IMPLEMENTING MOTION IN SEATS

(75) Inventors: Daniel Robert Jamele, Redondo Beach, CA (US); Norman Ellison, Los Angeles, CA (US)

(73) Assignee: MediaMotion, Inc., Torrance, CA (US)

( * ) Notice: Subject to any disclaimer, the term of this patent is extended or adjusted under 35 U.S.C. 154(b) by 104 days.

(21) Appl. No.: 13/373,349

(22) Filed: Nov. 10, 2011

(65) Prior Publication Data

US 2012/0119553 A1 May 17, 2012

Related U.S. Application Data

(60) Provisional application No. 61/456,799, filed on Nov. 12, 2010.

(51) Int. Cl.
*A47C 15/00* (2006.01)

(52) U.S. Cl.
USPC ..... 297/232; 297/248; 297/249

(58) Field of Classification Search
USPC ..... 297/232, 248, 249, 217.3, 217.7
See application file for complete search history.

(56) References Cited

U.S. PATENT DOCUMENTS 3,923,300 A * 12/1975 Tanus ..... 472/60
4,584,896 A 4/1986 Letovsky
4,879,849 A * 11/1989 Hollingsworth et al. ..... 52/10
5,015,933 A 5/1991 Watkins et al.
5,022,708 A * 6/1991 Nordella et al. ..... 297/327
5,678,889 A 10/1997 Purcell, Jr.
5,901,612 A 5/1999 Letovsky
5,954,508 A 9/1999 Lo et al.
6,024,647 A * 2/2000 Bennett et al. ..... 472/43
6,053,576 A 4/2000 Jessee
6,077,078 A 6/2000 Alet et al.
6,224,380 B1 5/2001 Lo et al.
6,445,960 B1 9/2002 Borta
6,733,293 B2 5/2004 Baker et al.
7,686,390 B2 3/2010 Dennis
7,866,747 B2 1/2011 Park
7,883,072 B2 2/2011 Kondo et al.
7,934,773 B2 5/2011 Boulais et al.
8,287,394 B2 * 10/2012 Gil et al. ..... 472/59
2010/0090507 A1 4/2010 Boulais et al.
2010/0205867 A1 8/2010 Park

OTHER PUBLICATIONS

Simulator ride, Wikipedia, the free encyclopedia, http://en.wikipedia.org/wiki/Simulator_ride, Nov. 5, 2011, pp. 1-3, USA.
Motion simulator, Wikipedia, the free encyclopedia, http://en.wikipedia.org/wiki/Motion_simulator, Nov. 5, 2011, p. 1-14, USA.

* cited by examiner

*Primary Examiner* — Sarah B McPartlin
(74) *Attorney, Agent, or Firm* — Robert Moll

(57) ABSTRACT

Motion seat systems and methods of powering motion seating are described. A modular design allows configurations as to the number and arrangement of seats, and provides each person on a seat with the same motion such as pitch and/or roll. The seats can be coupled together. Each seat has one or more rotary shafts that pass under or through the seat. One or more rotating shafts cause each seat to pitch and roll according to the position of the shaft(s). The shaft of a master seat is rotatably coupled to the shaft of one or more slave seats to transfer the motion to the slave seat(s).

35 Claims, 11 Drawing Sheets

MOTION SEAT SYSTEMS AND METHODS OF IMPLEMENTING MOTION IN SEATS

This application claims priority to U.S. provisional patent application No. 61/456,799, entitled X4D Motion EFX Cinema Seat Series, filed on Nov. 12, 2010, which is incorporated by reference in its entirety herein.

BACKGROUND

The present invention relates to motion seat systems and methods of implementing motion in seats.

Motion seat systems have been used in theme park rides such as Disney's Star Tours and Universal Studio's Back to the Future, in commercial movie theaters, in gaming environments, and in training centers (e.g., military, law enforcement, and flight schools) to produce the sensation one is immersed in the reality displayed on a screen by synchronizing the seat motion of the viewer to correspond to the displayed scenes.

Motion seat systems are adapted to receive motion signals that move seats to correspond (e.g., synchronize) to other signals (e.g., video and/or audio signals) that are perceived by person(s). For example, the motion seat system may synchronize seat motions with the displayed motions in a movie theater to simulate the forces one would experience seated in a vehicle in a chase scene where the vehicle races around a city street.

FIG. 1A shows that a motion signal can actuate forward and back pitch in the motion seat. The motion back simulates force pushing a person back if a vehicle suddenly accelerated while the motion forward simulates the vehicle suddenly braking.

FIG. 1B shows that a motion seat can be also rotated from side to side in a movement referred to as roll. Here the movement simulates the sideways force one would experience if a vehicle suddenly turned left or right. FIG. 1C shows a motion seat could also rotate horizontally about a vertical axis in a movement referred to as yaw. Although yaw simulates other forces a person might experience in the chase scene, it is less desired than pitch and roll, because yaw rotates a person away from the visual display which reduces the illusion of being in the displayed action plus requires great spacing between seats to avoid bumping moving seats together.

SUMMARY OF THE INVENTION

The invention relates to motion seat systems and methods of powering motion seating. Modular design allows a variety of configurations as to the number and alignment of the seats, and provides each person on a seat with the same motion such as pitch and/or roll. The system can be one or more seats coupled together.

Each seat has one or more rotary shafts that pass under or through the seat. One or more rotating shafts are coupled to and cause each seat to pitch and roll according to the position of the shaft(s). The shaft of a master seat may be rotatably coupled through to the shaft of one or more slave seats to transfer the motion to the slave seat(s) which reduces the overall cost of the system.

Using pneumatic, electric, or hydraulic power one or more actuators receiving motion signals linearly displace one or more links coupled to the shafts and to the seats.

In another aspect, a method of moving seats is described including rotating a segmented shaft including rigid segments rotatably coupled, wherein each rigid segment is coupled to a seat, and converting the rotation of the segmented shaft to a linear displacement producing a motion in the seat.

In another aspect, a system of moving seats is described including at least one segmented shaft including rigid segments rotatably coupled, wherein each rigid segment is coupled to a seat, at least one actuator to rotate the segmented shaft, and at least one rotary-to-linear motion converter to convert the rotation of the segmented shaft to a linear displacement producing a motion in the seat.

DETAILED DESCRIPTION OF THE PREFERRED EMBODIMENTS

The following description includes the best mode of carrying out the invention. The detailed description is made for the purpose of illustrating the general principles of the invention and should not be taken in a limiting sense. The scope of the invention is determined by reference to the claims. Each part is assigned its own part number throughout the specification and drawings.

Figure 1A:
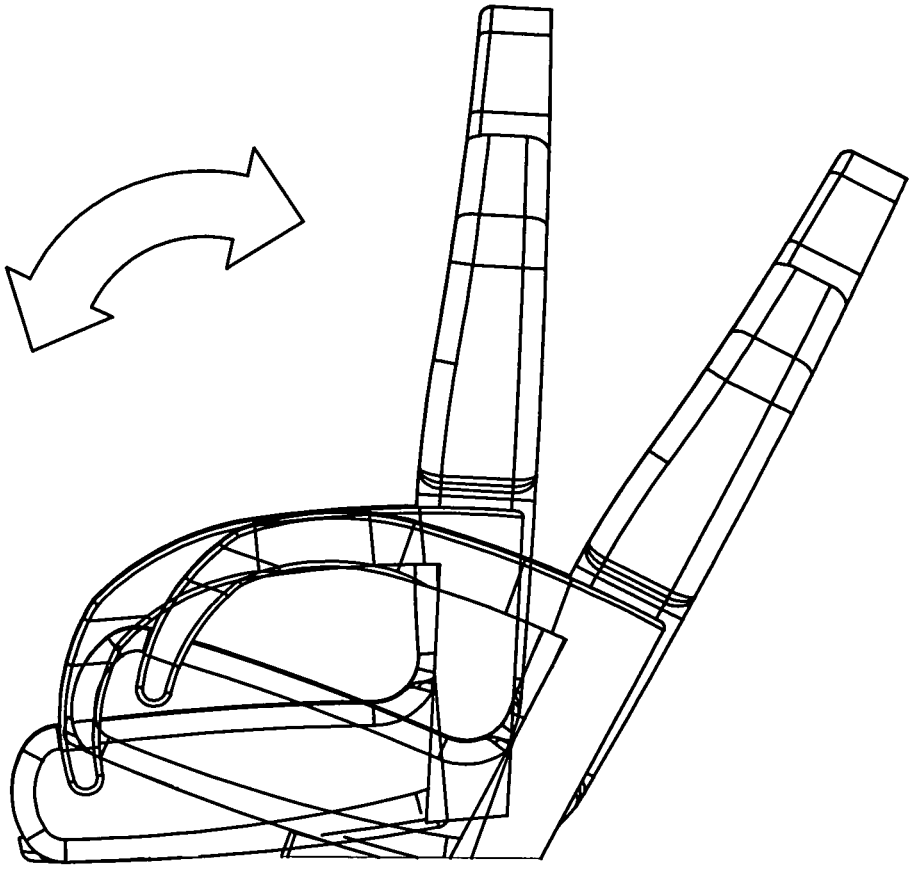
FIG. 1A illustrates pitch in a motion seat.
Figure 1B:
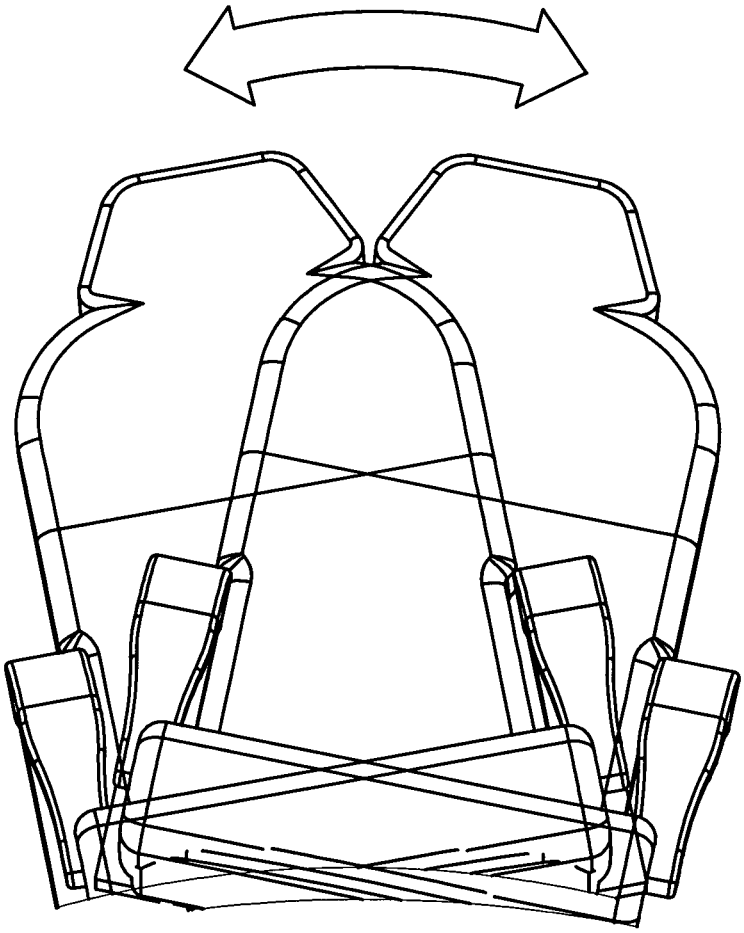
FIG. 1B illustrates roll in a motion seat.
Figure 1C:
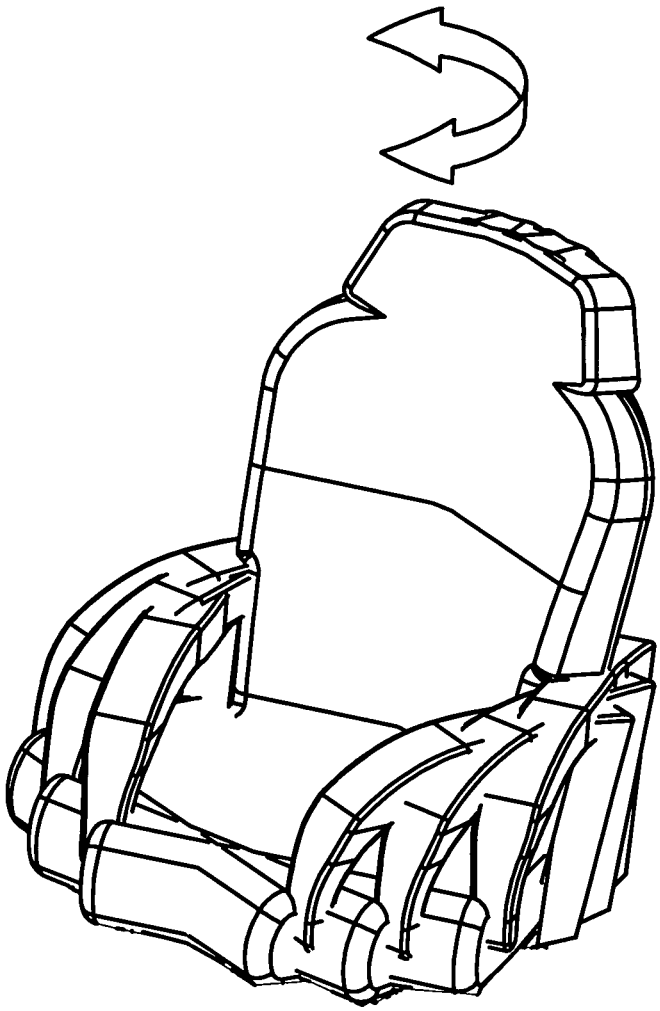
FIG. 1C illustrates yaw in a motion seat.
Figure 2:
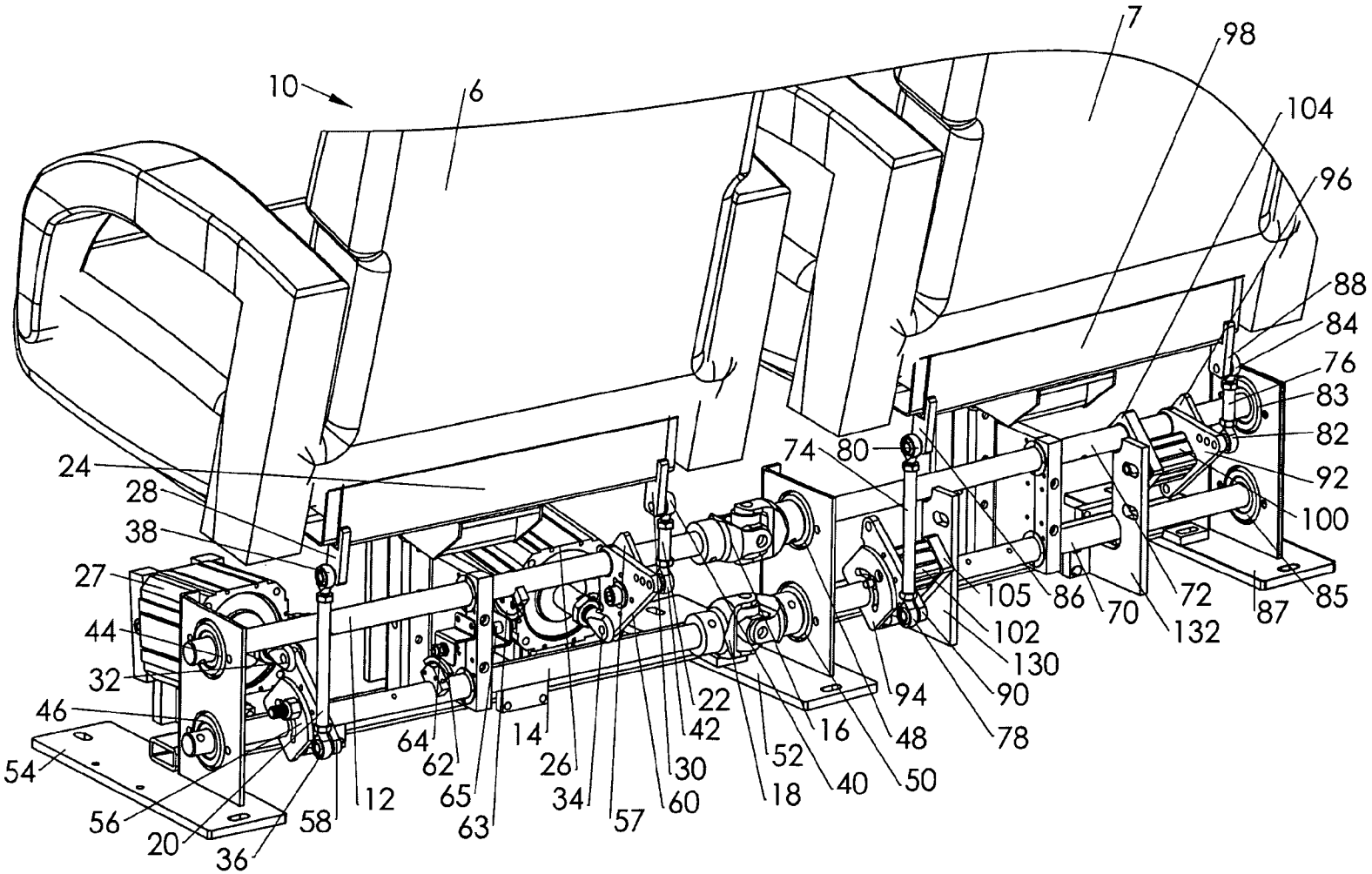
FIG. 2 illustrates a motion seat system with shafts connected to a plurality of seats.
Figure 4:
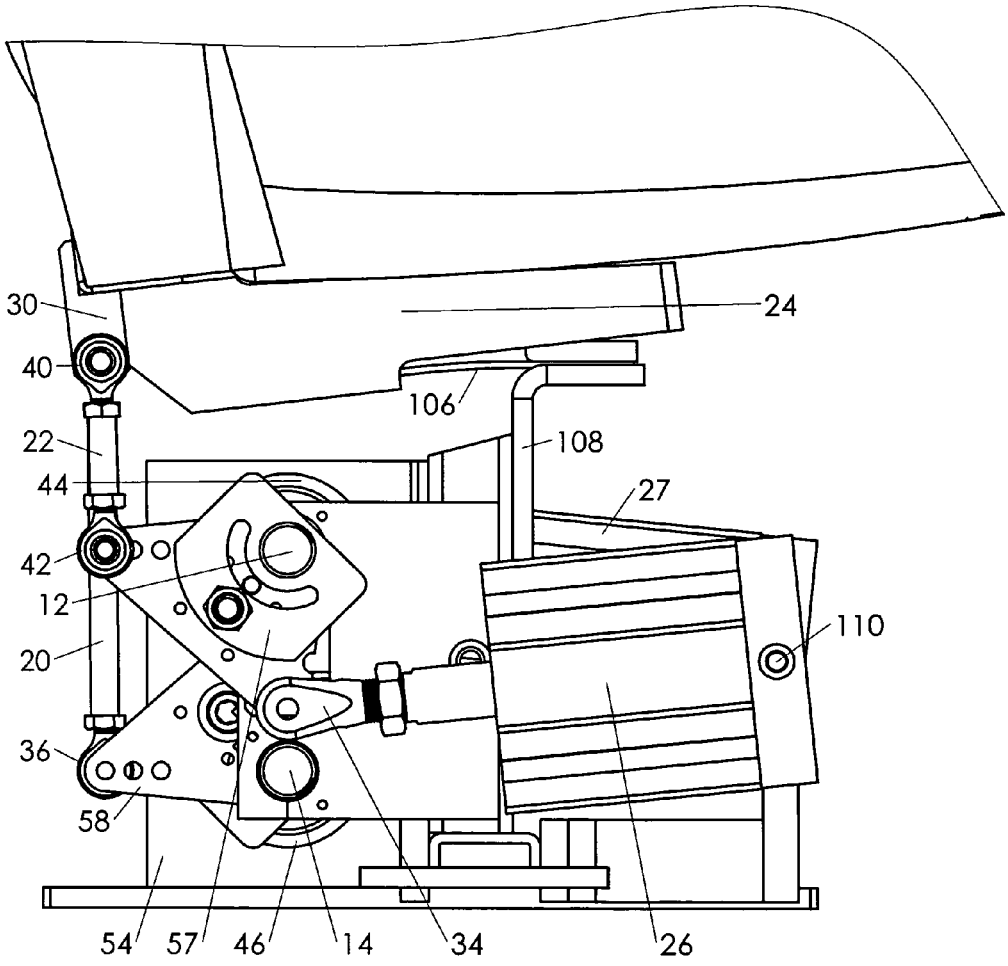
FIG. 4 is a side view of the master seat illustrating the details of the front support member including a leaf spring.

FIGS. 2 and 4 illustrate a motion system 10 for a plurality of seats (e.g., master seat 6 and slave seat 7).

In an embodiment, a first actuator 26 transmits a linear force based on a motion control signal to a first master actuator clevis mount 34 that is rotatably coupled to a first master actuator crank 60 that is secured to a first master shaft 12 that rotates in a shaft support bearing 44 in a master shaft support 54.

A first master link 22 with an upper link end 40 and a lower link end 42 couples the first master shaft 12 and the master seat mount 24. The upper link end 40 pivots at support point 30 which is attached or integral with the master seat mount 24, which is attached or integral to the master seat 6. Thus, the first actuator 26 drives motion to the master seat 6.

In an embodiment, a second actuator 27 transmits linear force based on a motion control signal to a second master actuator clevis mount 32 that is rotatably coupled to a second master actuator crank 58 that is secured to a second master shaft 14 that rotates in a shaft support bearing 46 in the master shaft support 54.

A second master link 20 with an upper link end 38 and a lower link end 36, spaced from the first master link 22, couples the second master shaft 14 to the master seat mount 24. The upper link end 38 pivots at support point 28 attached or part of the master seat mount 24, which is in turn attached or integral to the master seat 6. Thus, the second actuator 27 drives motion to the master seat 6.

If the first and second master shafts 12, 14 rotate, they will move the master seat 6 up and down simultaneously, the master seat 6 will move in a pitch motion; if not, the master seat 6 will move in a roll motion.

In the embodiment illustrated in FIG. 2, a rotary encoder 65 and an encoder gear 63 precisely detect the rotational position of the first master shaft 12. The output of the rotary encoder 65 includes a feedback output to an external control system (not part of this invention) and slows the angular rotation of the first master shaft 12 as it approaches the rotational position indicated by the motion signal.

In the embodiment illustrated in FIG. 2, a rotary encoder 64 and an encoder gear 62 precisely detect the rotational position of the second master shaft 14. The output of the rotary encoder 64 includes a feedback output to an external control system (not part of this invention) and slows the angular rotation of the second master shaft 14 as it approaches the rotational position indicated by the motion signal.

Referring to FIG. 2, a slave seat assembly includes a first slave shaft 72 rotatably held in a shaft support bearing 48 in a slave shaft support 52 at one end and in a shaft support bearing 83 in a shaft support 87 at the other end. A first slave link 76 with an upper link end 84 and a lower link end 82 is rotatably coupled to the first slave actuator crank 92 secured to or integral with the first slave shaft 72 and the slave seat mount 98. In an embodiment, the upper link end 84 pivots at support point 88 attached or part of the slave seat mount 98. The slave seat 7 is attached or integral to the slave seat mount 98.

The slave seat assembly also includes a second slave shaft 70 rotatably held in a shaft support bearing 50 in the slave shaft support 52 at one end and in a shaft support bearing 85 in the shaft support 87 at the other end. A second slave link 74 with an upper link end 80 and a lower link end 78 is rotatably coupled to the second slave actuator crank 90 secured to or integral with the second slave shaft 70 and the slave seat mount 98. The upper link end 80 pivots at support point 86 attached or part of the slave seat mount 98. The slave seat 7 is attached or integral to the slave seat mount 98.

Referring to FIG. 2, the motion system 10 also includes a first coupling member 16 (e.g., a universal joint) that rotatably couples the first master shaft 12 to the first slave shaft 72 between the master shaft support 54 and the slave shaft support 52. Each master shaft axis can be coincident or non-coincident with the slave shaft axis. Non-coincident permits the master seat 6 and slave seat 7 to be arranged to accommodate a curved row that may be desired in a movie theater. The first actuator 26 is driven by motion signals to rotate the first master shaft 12 such that the first master link 22 and the first slave link 76 are linearly displaced and produce motion in both the master seat mount 24 and slave seat mount 98.

Referring to FIG. 2, the motion system 10 also includes a second coupling member 18 (e.g., a universal joint) that rotatably couples the second master shaft 14 to the second slave shaft 70 between the master shaft support 54 and the slave shaft support 52. Each master shaft axis can be coincident or non-coincident with one or more slave shaft axis. Non-coincident permits the master seat 6 and slave seat 7 to be arranged to accommodate a curved row that may be desired at a movie theater. The second actuator 27 is driven by motion signals to rotate the second master shaft 14 such that the second master link 20 and the second slave link 74 are linearly displaced and produce motion in the master and slave seat mounts 24 and 98.

FIG. 4 is a side view that also illustrates a front support member (e.g., leaf spring 106) that supports the master seat 6, preferably at or near its center of gravity to reduce the power requirements of the first actuator 26. The type of actuator must have sufficient power (e.g., 2 horsepower) to rotate each master shaft and any slave shafts coupled to the master shaft, but the actuator type (e.g. hydraulic, pneumatic, and electric) is not essential to invention.

The front support member (e.g., leaf spring 106) allows two degrees of freedom, that is, pitch and roll, but inhibits yaw or other lateral motions. The leaf spring 106 acts as a spring to return the master seat 6 to a neutral position. A balance member 108, preferably L-shaped, and spaced from the first master link 22, supports the front support member (e.g., leaf spring 106).

FIGS. 2 and 4 illustrate that the first master link 22, the second master link 20, and the balance member 108 define a plane that can be coincident, co-planar, or not co-planar with the master seat mount 24.

Figure 8:
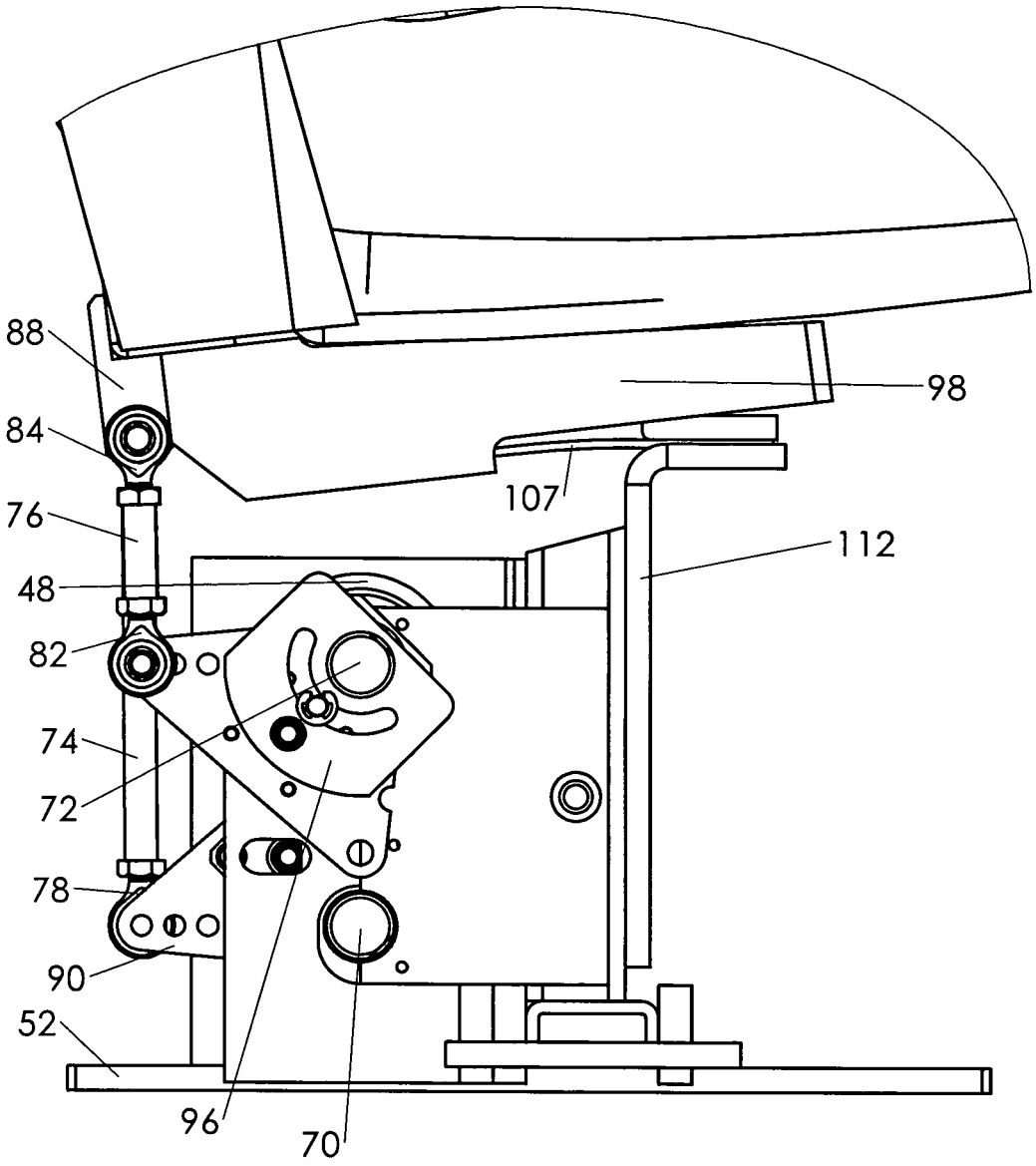
FIG. 8 is a side view of the slave seat assembly illustrating the details of the front support member including a leaf spring.

FIG. 8 is a side view of the slave seat 7 that illustrates the details of a front support member including a leaf spring 107 that supports the slave seat 7 preferably at or near the center of gravity of the slave seat 7 to reduce the power requirements of the first actuator 26 and to allow two degrees of freedom, that is, pitch and roll, but inhibit yaw or other lateral motion. A balance member 112 is spaced from the first slave link 76 to support the leaf spring 107.

FIGS. 2 and 8 illustrate that the first slave link 76, the second slave link 74, and the balance member 112 define a plane that can be coincident, co-planar or not co-planar with the slave seat mount 98.

In an embodiment, the slave seat assembly includes a locking mechanism for the first slave shaft 72 including a first slave shaft lock brace 96, a first slave locking actuator mount 104, and a first slave locking actuator 100.

In another embodiment, the slave seat assembly includes a locking mechanism for the second slave shaft 70 including a second slave shaft lock brace 94, a first slave locking actuator shaft mount 105, and a second slave locking actuator 102.

Figure 3:
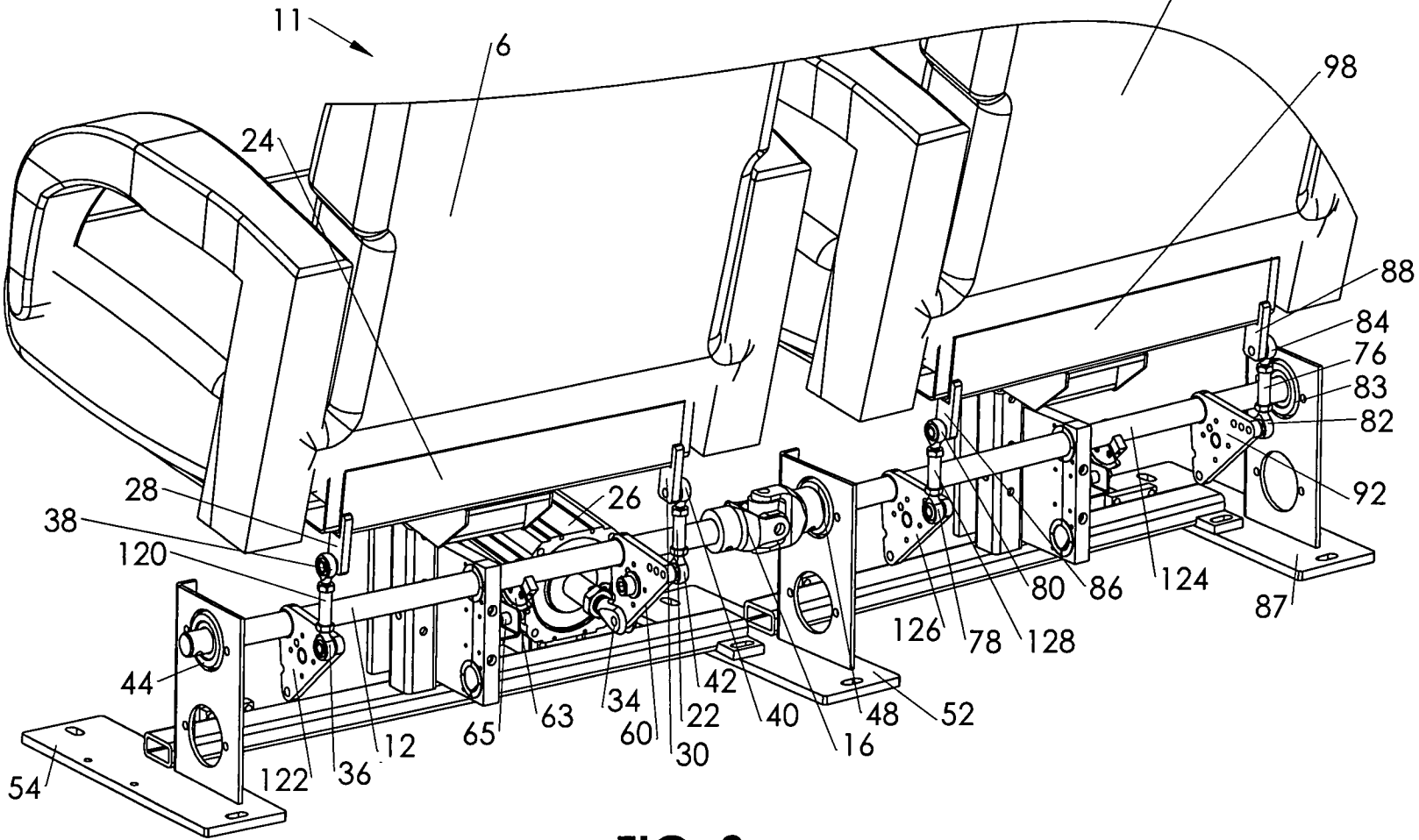
FIG. 3 illustrates an embodiment of a motion seat system with a single shaft connected to a plurality of seats.
Figure 6:
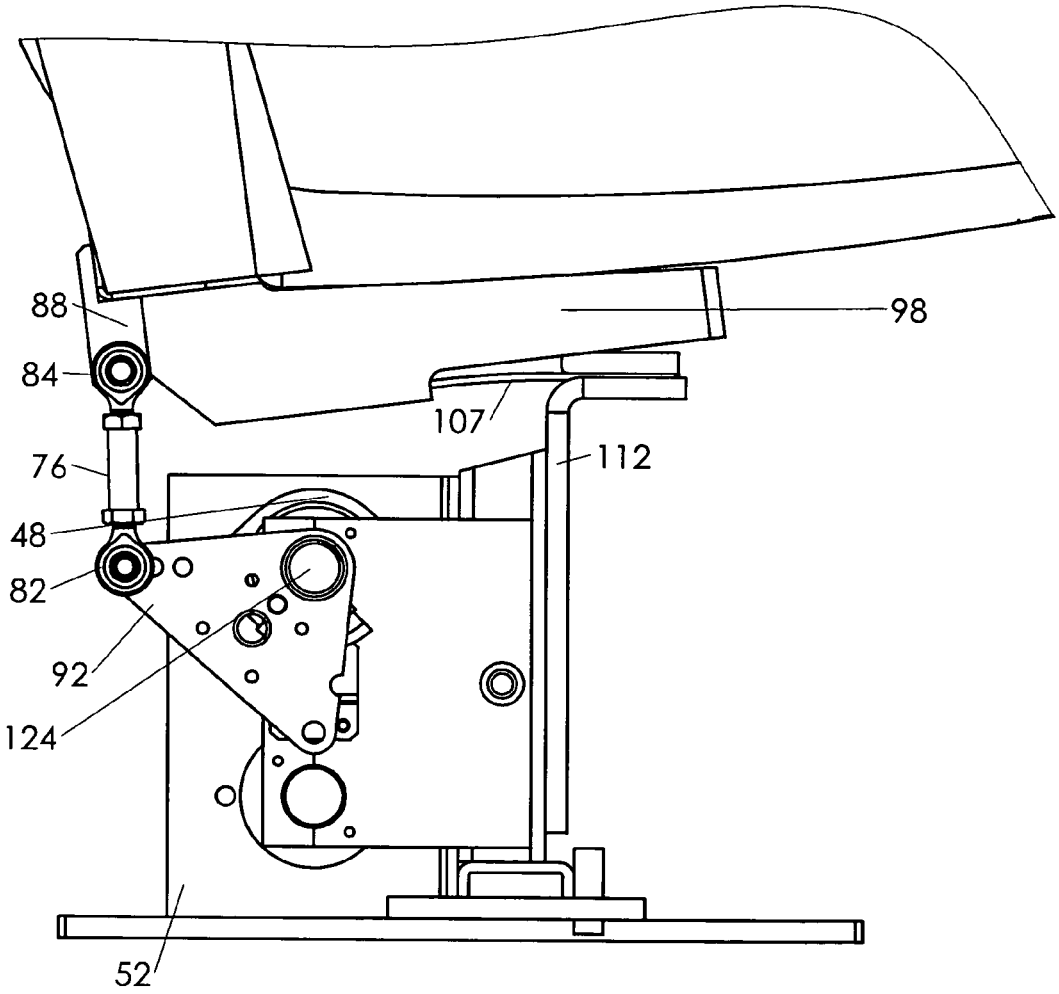
FIG. 6 illustrates an embodiment of a single motion seat with a master link and a leaf spring.

FIGS. 3 and 6 illustrate a single master shaft embodiment of the motion system 11 for a plurality of seats (e.g., master seat 6 and slave seat 7).

In an embodiment, an actuator 26 transmits a linear force based on a motion control signal to a first master actuator clevis mount 34 that is rotatably coupled to a master actuator crank 60 that is secured to a master shaft 12 that rotates in a shaft support bearing 44 in a master shaft support 54.

A first master link 22 with an upper link end 40 and a lower link end 42 couples the master shaft 12 and the master seat mount 24. The upper link end 40 pivots at support point 30 which is attached or integral with the master seat mount 24, which is attached or integral to the master seat 6. Thus, the actuator 26 drives motion to the master seat 6.

A second master link 120 with an upper link end 38 and a lower link end 36, spaced from the first master link 22, couples the master shaft 12 to the master seat mount 24. The upper link end 38 pivots at support point 28 attached or part of the master seat mount 24, which is in turn attached or integral to the master seat 6. The lower link end 36 is rotatably coupled to the second master crank 122 secured to the master shaft 12. Thus, if the master shaft 12 rotates, the master seat 6 moves up and down in a pitch motion.

In the embodiment illustrated in FIG. 3, a rotary encoder 65 and an encoder gear 63 will precisely detect the rotational position of the master shaft 12. The output of the rotary encoder 65 includes a feedback output that slows the angular rotation of the master shaft as it approaches the rotational position indicated by the motion signal.

Referring to FIG. 3, a slave seat assembly includes a slave shaft 124 rotatably held in a shaft support bearing 48 in a slave shaft support 52 at one end and in a shaft support bearing 83 in a slave shaft support 87 at the other end. A first slave link 76 with an upper link end 84 and a lower link end 82 is rotatably coupled to the slave actuator crank 92 secured to or integral with the slave shaft 124 and the slave seat mount 98. A second slave link 128 with an upper link end 80 and a lower link end 78 is rotatably coupled to the slave actuator crank 126 secured to or integral with the first shaft 124 and the slave seat mount 98. In an embodiment, the upper link ends 80, 84, pivot respectively at support points 86, 88 attached or part of the slave seat mount 98. The slave seat 7 is attached or integral to the slave seat mount 98.

Referring to FIG. 3, the motion system 11 also includes a first coupling member 16 (e.g., a universal joint) that rotatably couples the master shaft 12 to the slave shaft 124 between the master shaft support 54 and the slave shaft support 52. Each master shaft axis can be coincident or non-coincident with the slave shaft axis. Non-coincident permits the master seat 6 and slave seat 7 to be arranged to accommodate a curved row that may be desired in a movie theater. The actuator 26 is driven by motion signals to rotate the master shaft 12 such that the first master links 120, 22 and the first slave links 76, 128 are linearly displaced and produce motion in both the master seat mount 24 and slave seat mount 98.

FIG. 6 is a side view that illustrates a front support member (e.g., leaf spring 107) that supports the slave seat 7, preferably at or near its center of gravity to reduce the power requirements of the first actuator 26. The type of actuator must have sufficient power (e.g., 2 horsepower) to rotate each master shaft and any slave shafts coupled to the master shaft, but the actuator type (e.g. hydraulic, pneumatic, and electric) is not essential to invention.

The front support member (e.g., leaf spring 107) allows two degrees of freedom, that is, pitch and roll, but inhibits yaw or other lateral motions. The leaf spring 107 acts as a spring to return the slave seat 7 to a neutral position. A balance member 112, preferably L-shaped, and spaced from the first slave link 76, supports the front support member (e.g., leaf spring 107).

FIGS. 3 and 6 illustrate that the first slave link 76, the second slave link 128, and the balance member 112 define a plane that can be coincident, co-planar, or not co-planar with the slave seat mount 98.

FIG. 4 is a side view of the master seat that can be used for the single shaft embodiment of FIG. 3 illustrating the details of a front support member (e.g., leaf spring 106) that supports the master seat 6, preferably at or near its center of gravity to reduce the power requirements of a first actuator 26. The front support member (e.g., leaf spring 106) allows two degrees of freedom, that is, pitch and roll, but inhibits yaw or other lateral motions. A balance member 108 is spaced from the master link 22 to support the front support member (e.g., leaf spring 106).

The master links 20, 22 and the balance member 108 should define a plane so two of the three required points will be found in the balance member 108. The defined plane coupled to the master seat mount 24 can be co-planar, not co-planar, or coincident with the master seat mount 24.

Referring again to FIG. 3, a coupling member 16 (e.g., a universal joint) between the master shaft support 54 and the slave shaft support 52 rotatably couples the master shaft 12 to the slave shaft 124. The actuator 26 is driven by motion signals to rotate the master shaft 12 such that the first master link 22, the second master link 120, the first slave link 76, and the second slave link 128 are linearly displaced and produce motion in the master and slave seat mounts 24 and 98.

Figure 5:
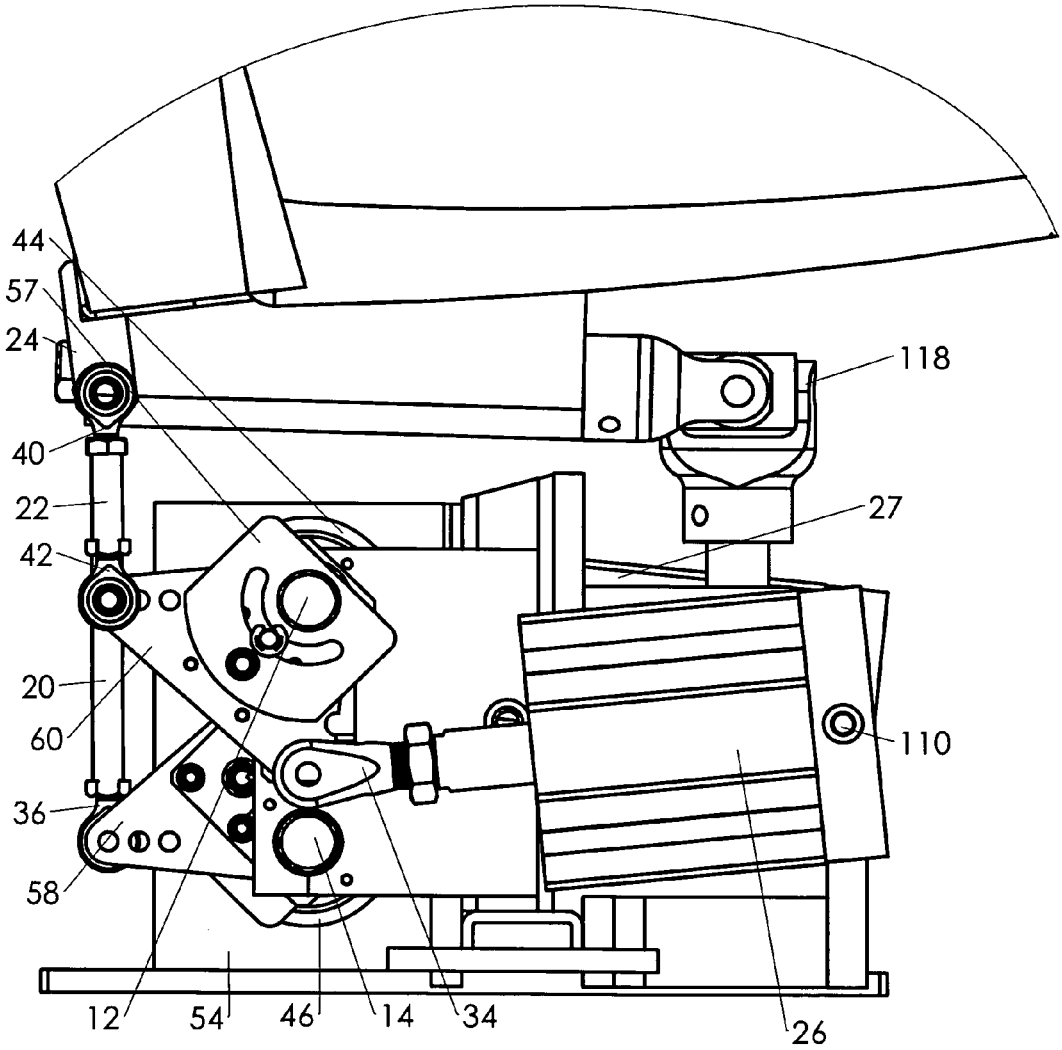
FIG. 5 is a side view of the master seat illustrating the details of the front support member including a U-joint.

FIG. 5 is a side view of an embodiment of the master seat 6 having a plurality of master shafts that illustrates an alternative front support member that includes a U-joint 118 in place of a leaf spring 106. FIG. 2 and the accompanying specification describe and explain the parts of this embodiment in detail.

FIG. 6 illustrates a side view of a slave seat assembly shown in a perspective view in FIG. 3. The slave seat assembly has a single slave shaft 124 and a front support member including a leaf spring 107. FIG. 3 and the accompanying specification previously describe the parts of this embodiment in detail.

Figure 7:
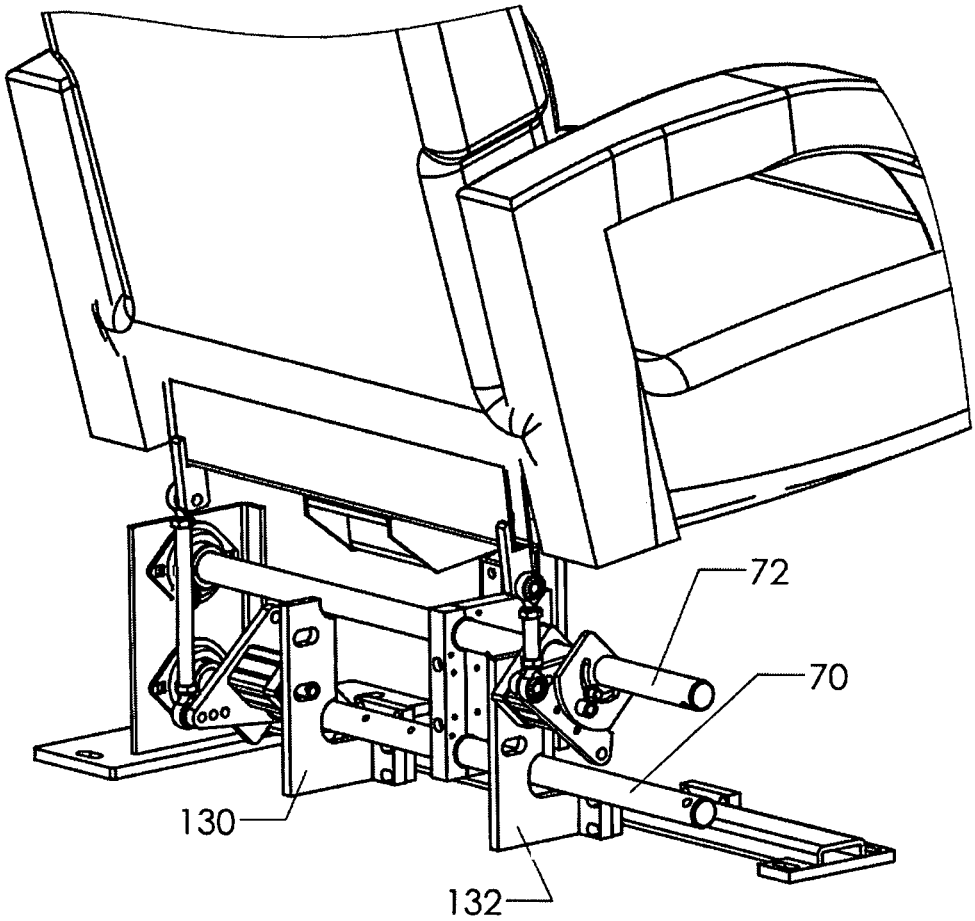
FIG. 7 illustrates a locking actuator mechanism for a slave seat.

FIG. 7 illustrates an alternative embodiment of a locking mechanism including locking plates 130 and 132 to prevent rotation of the first slave shaft 72 and the second slave shaft 70. FIG. 2 and the accompanying specification describe and explain the parts of this embodiment in detail.

Figure 9:
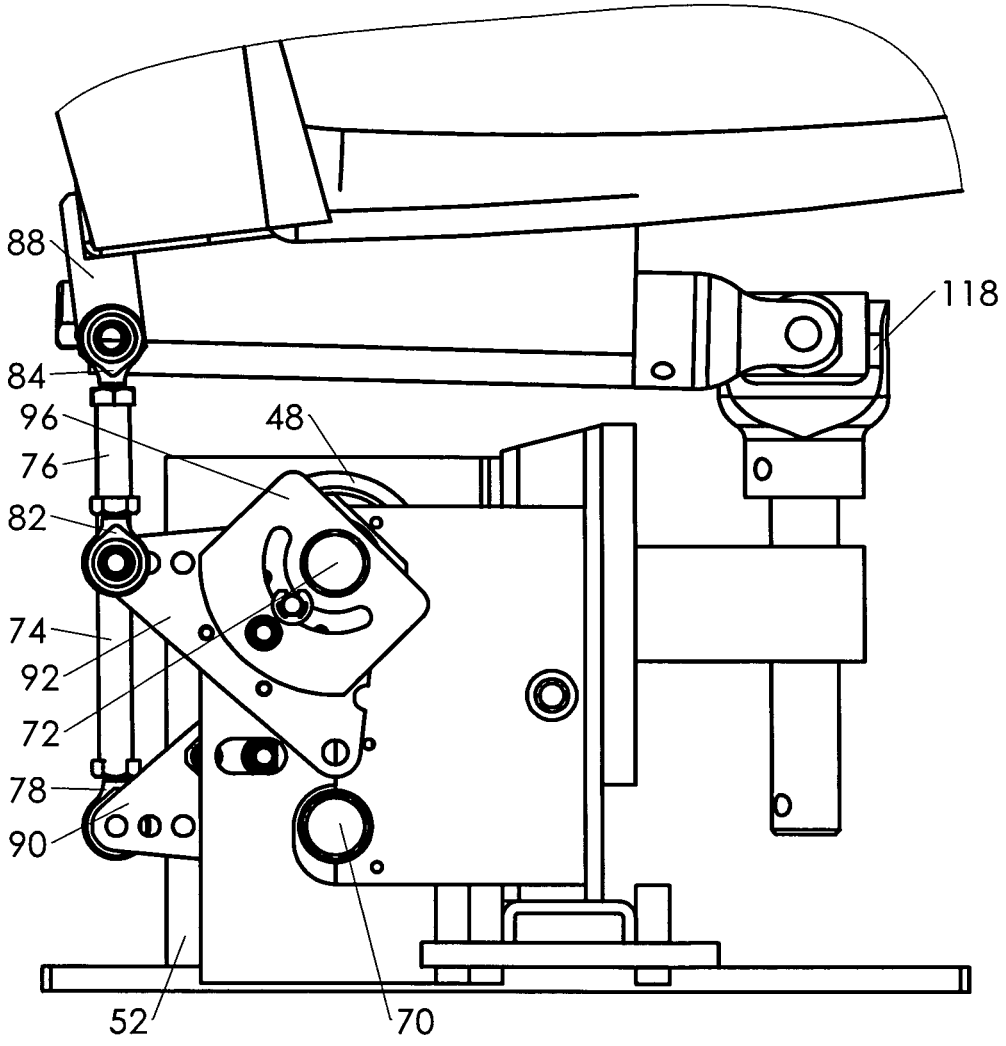
FIG. 9 is a side view of the slave seat assembly identical to FIG. 8, but for the front support member including a U-joint instead of a leaf spring.

FIG. 9 is a side view of the slave seat identical to FIG. 8, but for the front support member including a U-joint 118 instead of a leaf spring 106. FIG. 2 and the accompanying specification describe and explain the parts of this embodiment in detail.

Thus, a system of moving seats is described including at least one segmented shaft (e.g., master shaft+coupling member+slave shaft) including rigid segments (e.g. shafts) rotatably coupled, wherein each rigid segment is coupled to a seat, at least one actuator (e.g., actuators receiving motion signals) to rotate the segmented shaft, and at least one rotary-to-linear motion converter (e.g., master slave seat assembly) to convert the rotation of the segmented shaft to a linear displacement producing a motion in the seat (e.g., master seat and/or slave seat).

Further, methods of moving a plurality of seats is also described including rotating a segmented shaft including rigid segments rotatably coupled, wherein each rigid segment is coupled to a seat, and converting the rotation of the segmented shaft to a linear displacement producing a motion in the seat.

FIGS. 2 and 3 illustrate the motion systems and methods of implementing seat motion as involving a master and a slave seat. However, the inventors recognize the master seat may operate as a single seat and may not be coupled to a slave seat but implement the motion in a single seat. Further, the system may drive a plurality of slave seats as long as the actuator(s) have the required power to drive one or more master shafts rotatably coupled to their respective slave shafts to attain the seat motions in accordance with the signals from the external control system. It is also recognized that the motion seat system is not limited to only motion simulator seating designed for commercial theaters, theme parks, exhibits, home theaters, and gaming.

The design of the motion system allows unlimited configurations as to the number of seats, and also may provide each rider with the same experience at a relatively low cost. This differs from existing motion seating which are powered by active mechanism under each seat or bench, and from a bench design as each rider in a bench is physically in a different position and has a different experience when riding the seat.

Many of the parts of the systems can be purchased and implemented with high strength steel, but the person of ordinary skill would readily understand the materials and parts to use after review of the specification. Further, the choice of materials and conventional parts is not essential to the invention.

What is claimed:

1. A motion system for a plurality of seats comprising:

a master seat mount;

a master shaft rotatably held in a master shaft support;

a master link coupled to the master shaft and the master seat mount;

a balance member for the master seat mount spaced from the master link, wherein the master link and the balance member define a plane where coupled to the master seat mount;

a slave seat assembly comprising a slave seat mount, a slave shaft rotatably held in a slave shaft support, a slave link coupled to the slave shaft and the slave seat mount, and a balance member for the slave seat mount spaced from the slave link, wherein the slave link and the balance member define a plane where coupled to the slave seat mount;

a coupling member rotatably coupling the master shaft to the slave shaft between the master and slave shaft supports; and an actuator to rotate the master shaft such that the master link and the slave link are linearly displaced and produce motion in the master and slave seat mounts.

2. The motion system of claim 1, further comprising at least one more slave seat assembly having a slave shaft coupled to the master shaft.

3. The motion system of claim 2, further comprising a master seat attached to the master seat mount and a slave seat attached to the slave seat mount of each slave seat assembly.

4. The motion system of claim 3, wherein the balance member for the master seat mount attaches at a plurality of locations on the master seat mount.

5. The motion system of claim 2, further comprising a locking mechanism that decouples at least one slave link from its corresponding slave shaft.

6. The motion system of claim 1, wherein the master shaft axis is not coincident with the slave shaft axis.

7. The motion system of claim 1, wherein the master link attaches at a plurality of locations on the master seat mount.

8. The motion system of claim 1, wherein the balance member attaches at a plurality of locations on the master seat mount.

9. The motion system of claim 1, further comprising a locking mechanism that decouples the slave link from the slave shaft.

10. The motion system of claim 1, wherein the balance member includes a U-joint.

11. The motion system of claim 1, wherein the balance member includes a leaf spring.

12. The motion system of claim 1, further comprising a master seat attached to the master seat mount and a slave seat attached to the slave seat mount.

13. A motion system for a plurality of seats comprising:

a master seat mount;

a first master shaft rotatably held in a master shaft support;

a first master link coupled to the first master shaft and the master seat mount;

a second master shaft rotatably held in the master shaft support;

a second master link spaced from the first master link and coupled to the second master shaft and the master seat mount;

a balance member for the master seat mount spaced from the first and second master links, wherein the first and second master links and the balance member define a plane where coupled to the master seat mount;

a slave seat assembly comprising a slave seat mount, a first slave shaft rotatably held in a slave shaft support, a first slave link coupled to the first slave shaft and the slave seat mount, a second slave shaft rotatably held in the slave shaft support, a second slave link coupled to the second slave shaft and the slave seat mount, and a balance member for the slave seat mount spaced from the first and second slave links, wherein the first and second slave links and the balance member define a plane where coupled to the slave seat mount;

a first coupling member rotatably coupling the first master shaft to the first slave shaft;

a first actuator to rotate the first master shaft such that the first master link and the first slave link are linearly displaced and produce motion in the master and slave seat mounts;

a second coupling member rotatably coupling the second master shaft to the second slave shaft; and a second actuator to rotate the second master shaft such that the second master link and the second slave link are linearly displaced and produce motion in the master and slave seat mounts.

14. The motion system of claim 13, further comprising at least one more slave seat assembly having first and second slave shafts coupled respectively to the first and second master shafts.

15. The motion system of claim 14, further comprising a master seat attached to the master seat mount and a slave seat attached to the slave seat mount of each slave seat assembly.

16. The motion system of claim 14, further comprising a locking mechanism that decouples one of the first and second slave links from their respective first and second slave shafts.

17. The motion system of claim 13, wherein the first master shaft axis is not coincident with the first slave shaft axis and the second master shaft axis is not coincident with the second slave shaft axis.

18. The motion system of claim 13, further comprising a locking mechanism that decouples the first and second slave links from the first and second slave shafts.

19. The motion system of claim 13, wherein the balance member includes a U-joint to prevent motion.

20. The motion system of claim 13, wherein the balance member includes a leaf spring.

21. The motion system of claim 13, further comprising a master seat attached to the master seat mount and a slave seat attached to the slave seat mount.

22. A method of moving a plurality of seats, comprising:

rotating a segmented shaft including a coupling member that rotatably couples a master rigid segment to a slave rigid segment;

rotatably coupling a master link to the master rigid segment and a master seat mount;

rotatably coupling a slave link to the slave rigid segment and a slave seat mount; and converting the rotation of the segmented shaft to a linear displacement of the master link and the slave link producing a motion in the master seat mount and the slave seat mount.

23. The method of claim 22, further comprising balancing the master seat mount and the slave seat mount against the motion.

24. The method of claim 23, wherein balancing against the motion includes reducing yaw, surge, and sway motions.

25. The method of claim 22, wherein the motion of the master seat mount and the slave seat mount is identical.

26. The method of claim 22, wherein the linear displacement produces at least pitch, roll or heave motion in the master seat mount and the slave seat mount.

27. The method of claim 22, wherein the segmented shaft is not coincident with a line such that the plurality of seats need not be arranged in a straight row.

28. The method of claim 22, further comprising decoupling the slave seat mount from the segmented shaft such that the slave seat mount is isolated from the motion.

29. A system of moving a plurality of seats, comprising:

at least one segmented shaft including a master rigid segment, one or more slave rigid segments, and one or more coupling members, wherein the coupling member(s) are adapted to rotatably couple the master rigid segment to the slave rigid segment(s);

a master link rotatably coupled to the master rigid segment and a master seat mount;

one or more slave links wherein one slave link is rotatably coupled to each slave rigid segment and each slave seat mount;

at least one actuator to rotate the segmented shaft; and at least one rotary-to-linear motion converter to convert the rotation of the segmented shaft to a linear displacement of the master link and the slave link(s) producing a motion in the master seat mount and each of the slave seat mounts.

30. The system of claim 29, further comprising a balancing member to balance the master seat mount and each slave seat mount against the motion.

31. The system of claim 30, wherein the balance member is adapted to reduce yaw, surge, and sway motions.

32. The system of claim 29, wherein the motion of the master seat mount and each slave seat mount is identical.

33. The system of claim 29, wherein the linear displacement will produce at least pitch, roll or heave motion in the master seat mount and each slave seat mount.

34. The system of claim 29, wherein the at least one segmented shaft is not coincident with a line such that the plurality of seats need not be arranged in a straight row.

35. The system of claim 29, further comprising a lock mechanism to decouple one slave seat mount from the segmented shaft such that one slave seat mount is isolated from the motion.

* * * * *

UNITED STATES PATENT AND TRADEMARK OFFICE

CERTIFICATE OF CORRECTION

PATENT NO. : 8,585,142 B2
APPLICATION NO. : 13/373349
DATED : November 19, 2013
INVENTOR(S) : Daniel Robert Jamele and Norman Ellison It is certified that error appears in the above-identified patent and that said Letters Patent is hereby corrected as shown below:

On the title page, item 73 Assignee: MediaMotion, Inc. should read --MediaMation, Inc.--.

Signed and Sealed this
Thirty-first Day of May, 2016

Michelle K. Lee

Michelle K. Lee
*Director of the United States Patent and Trademark Office*